US006719336B2

(12) United States Patent
Sato

(10) Patent No.: US 6,719,336 B2
(45) Date of Patent: Apr. 13, 2004

(54) DOOR HANDLE ASSEMBLING CONSTRUCTION

(75) Inventor: Hiroyuki Sato, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/184,734

(22) Filed: Jun. 27, 2002

(65) Prior Publication Data

US 2003/0001399 A1 Jan. 2, 2003

(30) Foreign Application Priority Data

Jun. 29, 2001 (JP) ..... 2001-198008

(51) Int. Cl.[7] ..... F05B 3/00
(52) U.S. Cl. ..... 292/336.3; 292/347; 292/348
(58) Field of Search ..... 292/336.3, 347, 292/348

(56) References Cited

U.S. PATENT DOCUMENTS 3,054,634 A * 9/1962 Westerdale ..... 292/336.3
4,412,696 A * 11/1983 Ishii et al. ..... 292/336.3
4,478,445 A * 10/1984 Shimizu ..... 292/336.3
4,892,342 A * 1/1990 Newman et al. ..... 292/347
5,284,373 A * 2/1994 Watson ..... 292/347
6,108,979 A * 8/2000 Saffran et al. ..... 49/503
6,363,577 B1 * 4/2002 Spitzley ..... 16/412
6,447,030 B1 * 9/2002 Meinke ..... 292/347
6,454,325 B1 * 9/2002 Ramsey et al. ..... 292/347
6,554,331 B2 * 4/2003 Ciborowski et al. ..... 292/347
6,565,134 B1 * 5/2003 Stuart et al. ..... 292/336.3
6,575,508 B2 * 6/2003 Stuart et al. ..... 292/336.3

FOREIGN PATENT DOCUMENTS

DE 197 49 311 A1 5/1999

* cited by examiner

*Primary Examiner*—Robert J. Sandy
*Assistant Examiner*—Carlos Lugo
(74) *Attorney, Agent, or Firm*—Alston & Bird LLP

(57) ABSTRACT

A door handle assembling construction includes a grip portion with a base portion at one end and a case portion at the other end. The grip portion has an arm portion, and the case portion has a hole and a wall portion for receiving the arm portion. The wall portion includes a stopper portion, and the arm portion includes a corner portion. The grip portion is subjected to an urging force in the direction toward the case portion. Before an outside handle is installed to a door outer panel, the grip portion is pulled out of the case portion, and the case portion tilts relative to its position after the outside handle is installed to the door outer panel. The corner portion of the arm portion engages the stopper portion to temporarily hold grip portion. When the tilt angle is returned, the engagement is released.

5 Claims, 10 Drawing Sheets

DOOR HANDLE ASSEMBLING CONSTRUCTION

FIELD OF THE INVENTION AND RELATED ART STATEMENT

The present invention relates to a door handle assembling construction used for an outside handle of, for example, a four-wheel vehicle.

When an outside handle 3 is assembled to a door outer panel 5 of an automobile door as shown in FIG. 3, a grip portion 32 of the outside handle 3 is pulled to turn a bell crank 34, and then is moved to a position in which the bell crank 34 is less liable to interfere with a square hole 5*d* in the door outer panel 5 as shown in FIGS. 9 and 10 to prevent interference of the bell crank 34 and a counter weight 38, which constitute a mechanism section of the outside handle 3, with the door outer panel 5. At the time of assembling, the worker must always perform a motion of passing the bell crank 34 through the square hole 5*d* while pulling the grip portion 32.

With this method, the worker must perform the assembling work while maintaining, by hand, a state in which the grip portion 32 is pulled out against the urging force of a spring 35. Therefore, the worker is forced to keep an unnatural posture and a pulling force. This work is a troublesome work, and thus it brings about an increase in fatigue of worker and a decrease in work efficiency.

In order to decrease the force for pulling out the grip portion 32 to make the work easy to do, it can be thought that the reaction force of the spring 35 is decreased so that the worker can pull out the grip portion 32 easily, thereby reducing the load on the worker.

In some cases, however, the reaction force of the spring 35 is increased so as to improve the sense of heaviness in order to take measures for the improvement in the sense of operation of the outside handle 3, the improvement in the quality of sound in opening and closing the door, the prevention of opening of door at the time of side impact, and the like. Also, in some cases, the reaction force of the spring 35 is utilized to secure a weight balance between the grip portion 32 and the handle mechanism section 34, 38. Thus, there is a tendency to increase the reaction force of the spring 35 according to the conditions, so that it is difficult to decrease the urging force of the spring 35 to a degree such as not to impose a load on the worker.

Also, even if the force for the worker to pull out the grip portion 32 is decreased, the pulling motion itself cannot be eliminated. Also, as described above, the decrease in the reaction force of the spring 35 degrades the quality such as the sense of operation, the quality of sound, and the prevention of opening of door.

As a method for solving the above-described problems, there is available a method in which the outside handle 3 is temporarily fixed by using a separate stopper 8 that does not relate to the function of the outside handle 3 as shown in FIG. 17. In this method, the stopper 8 is inserted between the grip portion 32 and a case portion 33 by pulling out the outside handle 3, and the stopper 8 is temporarily fixed by utilizing a force of pulling the grip portion 32 in the direction of F2 by means of the spring 35, by which a state in which the outside handle 3 is pulled is maintained. The use of this method eliminates the need for decreasing the reaction force of the spring 35 and enables the spring 35 to be set freely.

In this method, however, it is necessary to perform the work for installing the stopper 8 to the outside handle 3 and the work for removing the stopper 8 after the outside handle 3 is assembled to a door 2. Therefore, the number of work steps increases undesirably. Also, since it is difficult to use the removed stopper 8 for another purpose as a part assembled to the vehicle, the removed stopper 8 must be disposed of or recycled. Therefore, the manpower for waste disposal and management work relating to the vendor is needed. That is to say, the above-described method suffers disadvantages in terms of environment, work manpower, and parts control.

OBJECT AND SUMMARY OF THE INVENTION

An object of the present invention is to provide a door handle assembling construction in which the cost can be reduced without decreasing the work efficiency.

The present invention provides a door handle assembling construction comprising a grip portion used for a door opening operation, a base portion for installing one end of the grip portion to a door panel, a case portion for installing the other end of the grip portion to the door panel, and an arm portion capable of being brought into and out of the case portion, which is erected on the back face at the other end of the grip portion, the grip portion being subjected to an urging force in the direction such that the arm portion is pulled toward the door inside, and a mechanism section which releases a door latch interlocking with the motion of pulling out the grip portion against the urging force being provided on the case portion, wherein when the arm portion is tilted in the direction different from the direction such as to be pulled toward the door inside after the grip portion is pulled out, the arm portion engages with the case portion and is kept in the pulled-out state, and by returning the arm portion in the direction such as to be pulled toward the door inside, the engagement is released.

The case portion has a wall portion erected on the back face thereof and a protruding portion provided on the wall portion, and the arm portion moves in the wall portion and the tip end thereof engages with the protruding portion on the wall portion.

The arm portion moving in the wall portion is formed into an arcuate shape, the grip portion turns around the base portion when being pulled out, and the protruding portion of the wall portion is provided at a position facing the outer peripheral surface of the arm portion and can be engaged with a corner portion on the outer peripheral surface side of the arm portion.

The protruding portion of the wall portion is provided on a face extending substantially in parallel with the lengthwise direction of the grip portion, and the arm portion is engaged with the protruding portion of the wall portion by tilting the grip portion around the lengthwise axis thereof.

The case portion has a wall portion erected on the back face thereof and a protruding portion provided on the wall portion, and the arm portion moves in the wall portion and is provided with a concave portion capable of being engaged with the protruding portion of the wall portion in the external surface thereof.

The protruding portion of the wall portion is arranged in a pair so as to face each other, and the concave portion of the arm portion is formed in a pair so as to be engaged with the protruding portions.

The present invention provides a door handle assembling construction comprising a grip portion used for a door opening operation, a base portion for installing one end of the grip portion to a door panel, a case portion for installing the other end of the grip portion to the door panel, and an arm portion capable of being brought into and out of the case portion, which is erected on the back face at the other end of the grip portion, the grip portion being subjected to an urging force in the direction such that the arm portion is pulled toward the door inside, and a mechanism section which releases a door latch interlocking with the motion of pulling out the grip portion against the urging force being provided on the case portion, wherein when the arm portion is tilted in the direction different from the direction such as to be pulled toward the door inside after the grip portion is pulled out, the arm portion engages with the case portion and is kept in the pulled-out state, and by returning the arm portion in the direction such as to be pulled toward the door inside, the engagement is released. Therefore, even if a stopper part as in the case of the conventional construction is not used, the work efficiency is not decreased, and the cost can be reduced.

If the case portion has a wall portion erected on the back face thereof and a protruding portion provided on the wall portion, and the arm portion moves in the wall portion and the tip end thereof engages with the protruding portion on the wall portion, a simple construction can be provided, and thus a rise in cost and an increase in product weight due to the application of the present invention can be eliminated substantially.

If the arm portion moving in the wall portion is formed into an arcuate shape, the grip portion turns around the base portion when being pulled out, and the protruding portion of the wall portion is provided at a position facing the outer peripheral surface of the arm portion and can be engaged with a corner portion on the outer peripheral surface side of the arm portion, the temporarily held state can be established with a little force.

If the protruding portion of the wall portion is provided on a face extending substantially in parallel with the lengthwise direction of the grip portion, and the arm portion is engaged with the protruding portion of the wall portion by tilting the grip portion around the lengthwise axis thereof, the temporarily held state can be established with a little force.

If the case portion has a wall portion erected on the back face thereof and a protruding portion provided on the wall portion, and the arm portion moves in the wall portion and is provided with a concave portion capable of being engaged with the protruding portion of the wall portion in the external surface thereof, the manufacturing can be performed easily.

If the protruding portion of the wall portion is arranged in a pair so as to face each other, and the concave portion of the arm portion is formed in a pair so as to be engaged with the protruding portions, the temporarily held state is more stable.

DETAILED DESCRIPTION OF PREFERRED EMBODIMENTS

Figure 1:
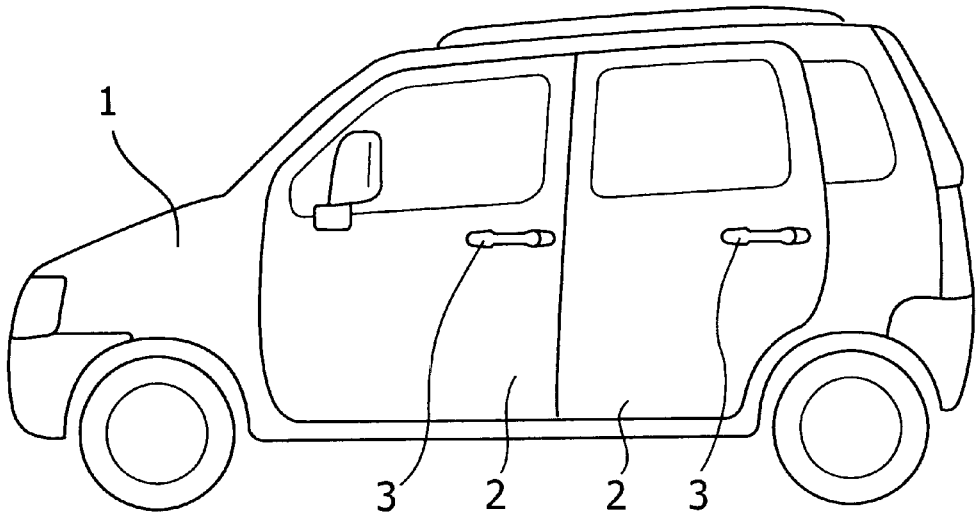
FIG. 1 is a side view of a motor vehicle to which a door handle assembling construction in accordance with one embodiment of the present invention is applied.

An embodiment of a door handle assembling construction in accordance with the present invention will be described below with reference to the accompanying drawings. In the description of the embodiment, same reference numerals applied to elements which are essentially the same as the elements in the related art are used.

First, the basic construction of an automobile door and an outside handle to which the present invention can be applied will be explained below. FIG. 1 is a side view of a motor vehicle 1 to which the door handle assembling construction in accordance with the present invention can be applied. In this embodiment, the present invention is applied to an outside handle 3.

Figure 2:
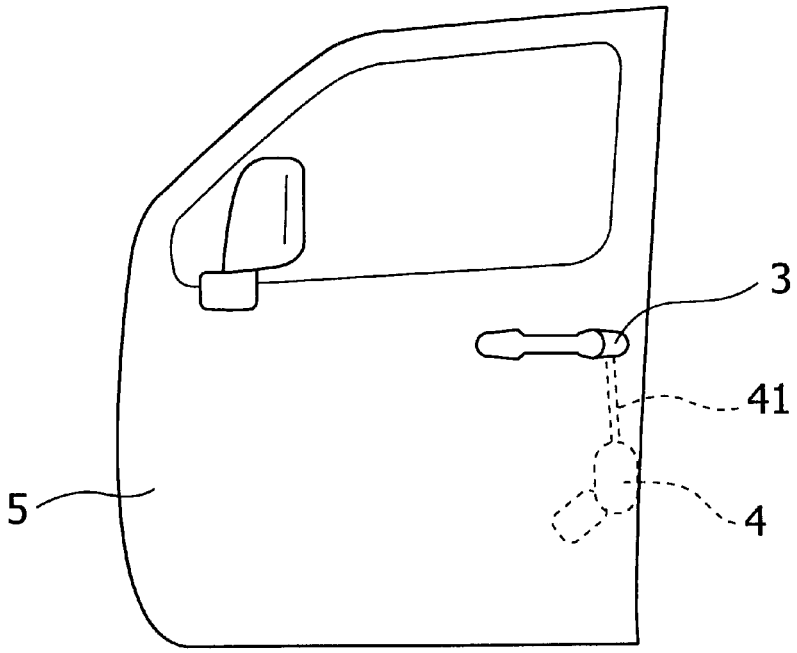
FIG. 2 is a side view of a front door shown in FIG. 1.

As shown in FIG. 1, two doors 2 are arranged on each side face of the motor vehicle 1. On the cabin outside of the door 2, the outside handle 3 is arranged to open the door 2. The outside handle 3 is connected to a door latch 4 arranged in the door 2 via a rod 41 as shown in FIG. 2.

Figure 3:
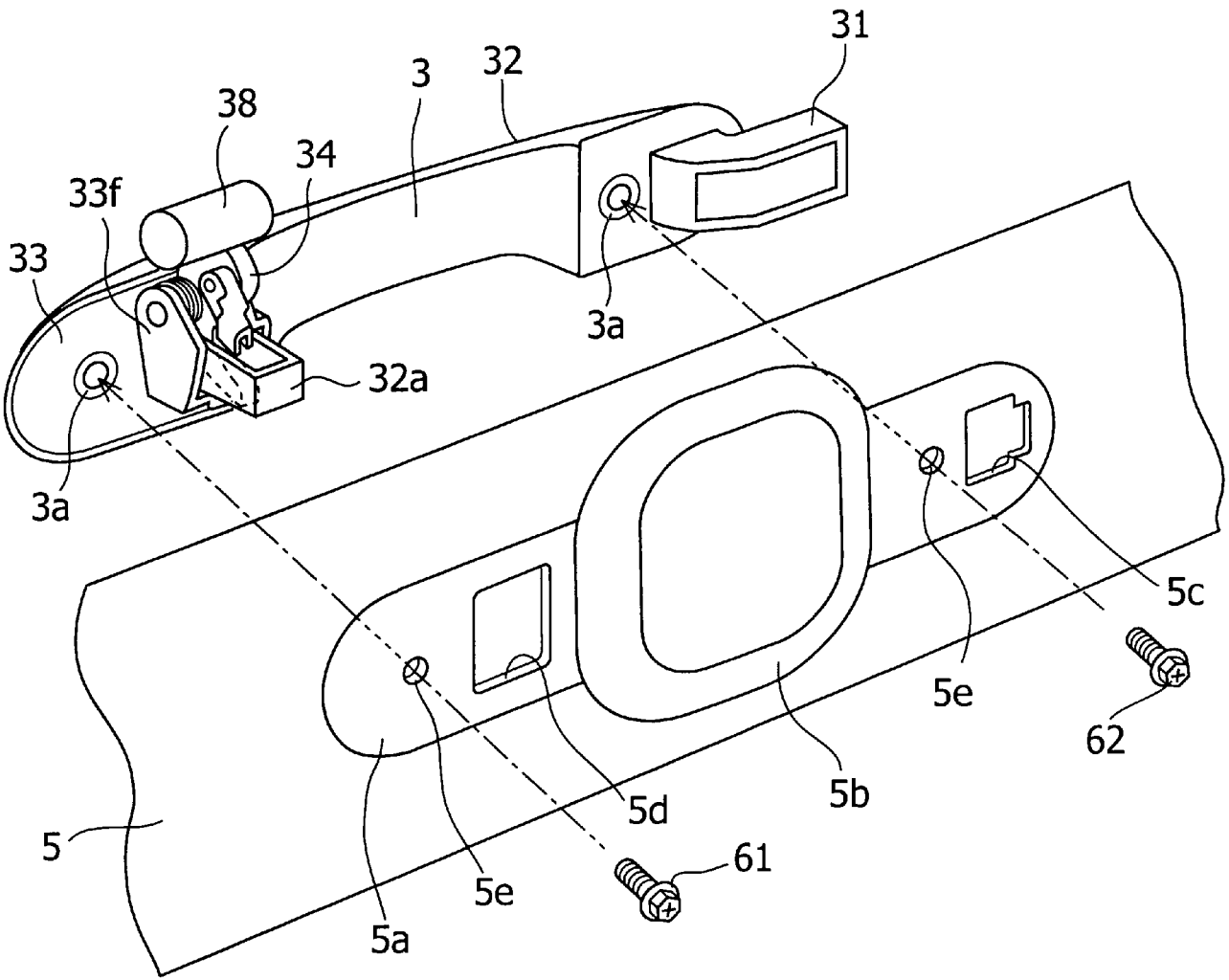
FIG. 3 is an exploded perspective view showing the installation of an outside handle shown in FIG. 1 to a door outer panel.
Figure 4:
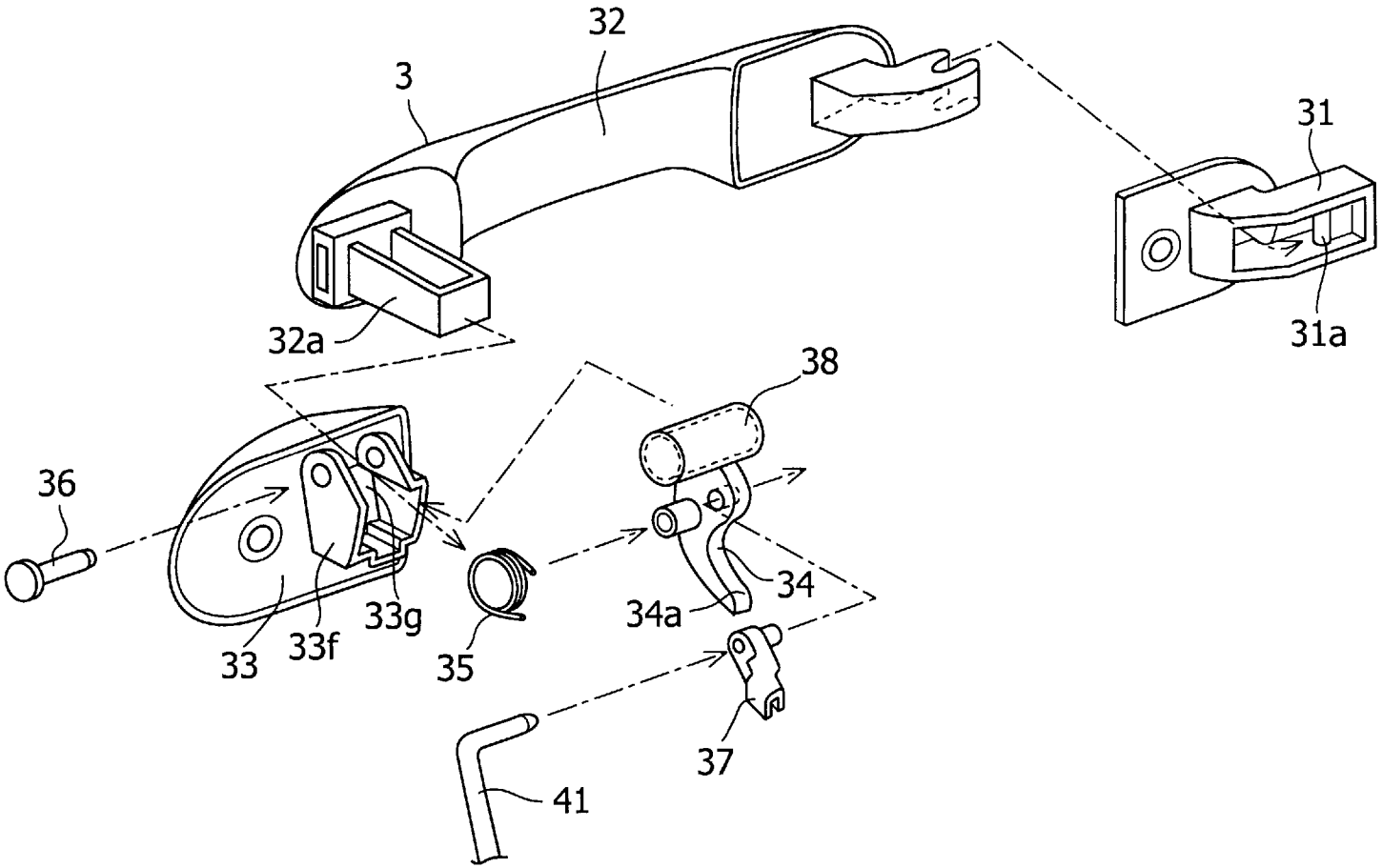
FIG. 4 is an exploded perspective view of an outside handle shown in FIG. 1.

The construction of the outside handle 3 will be explained with reference to FIGS. 3 to 6. As shown in FIG. 4, the outside handle 3 is mainly made up of a grip portion 32 for gripping the handle 3, a base portion 31 installed on one end side of the grip portion 32, and a case portion 33 installed on the other end side of the grip portion 32. As shown in FIG. 3, the grip portion 32 is fixed to a door outer panel 5 via the base portion 31 and the case portion 33.

As shown in FIG. 4, the case portion 33 is formed with a hole 33*g* through which an arm portion 32*a* projecting from the back side (front side of the figure) of the grip portion 32 to the cabin side is inserted. On the back face of the case portion 33, a wall portion 33*f* is erected so as to surround the hole 33*g*. When the case portion 33 is fixed to the door outer panel 5, the wall portion 33*f* erects toward the door inside (see FIG. 3). Also, the wall portion 33*f* is mounted with a bell crank 34 serving as a mechanism section with a pin 36 so as to be turnable. Further, the bell crank 34 is connected to the rod 41 of the door latch 4 by a clip 37.

Figure 13:
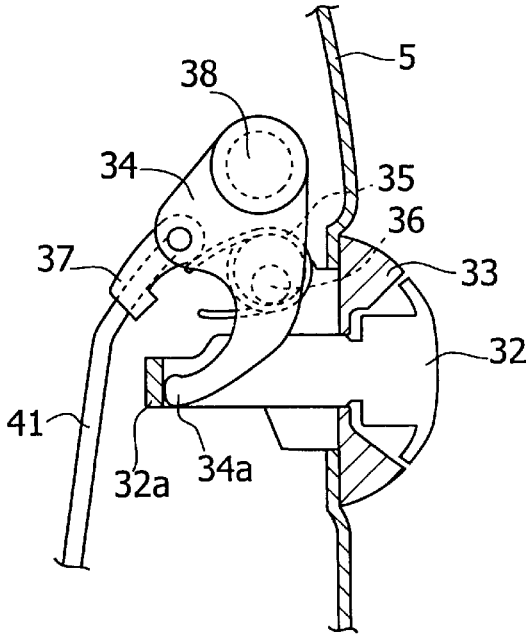
FIG. 13 is a longitudinal sectional view of FIG. 11, showing a portion near an arm portion.
Figure 14:
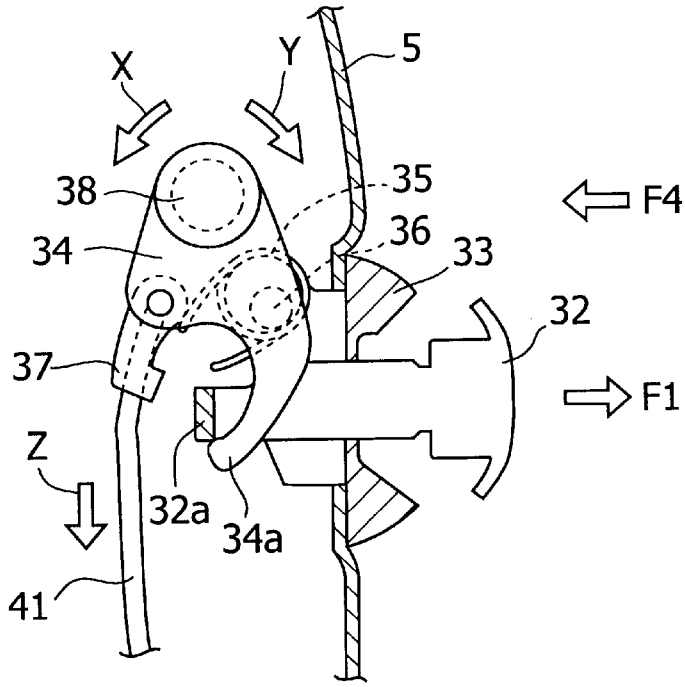
FIG. 14 is a longitudinal sectional view of FIG. 12, showing a portion near an arm portion.

The bell crank 34 is urged in the direction such as to pull up the rod 41 by a spring 35 (see FIGS. 13 and 14). At the upper part of the bell crank 34 is fixed a counterweight 38. The counterweight 38 plays a role of a balance weight for preventing unintended rotation of the bell crank 34 caused when the grip portion 32 is pulled out to the outside by an inertial force at the time when a shock is applied to the door from the outside.

Figure 5:
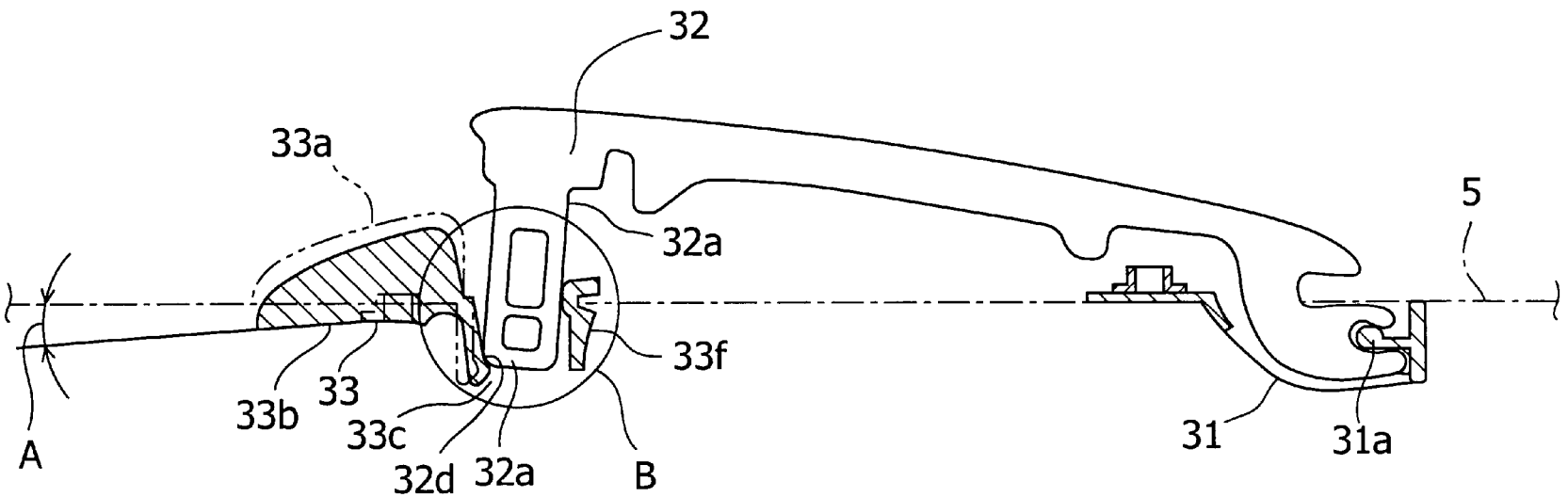
FIG. 5 is a plan view showing a part of an outside handle shown in FIG. 1 in a state in which a grip portion is pulled out to tilt a case portion.
Figure 6:
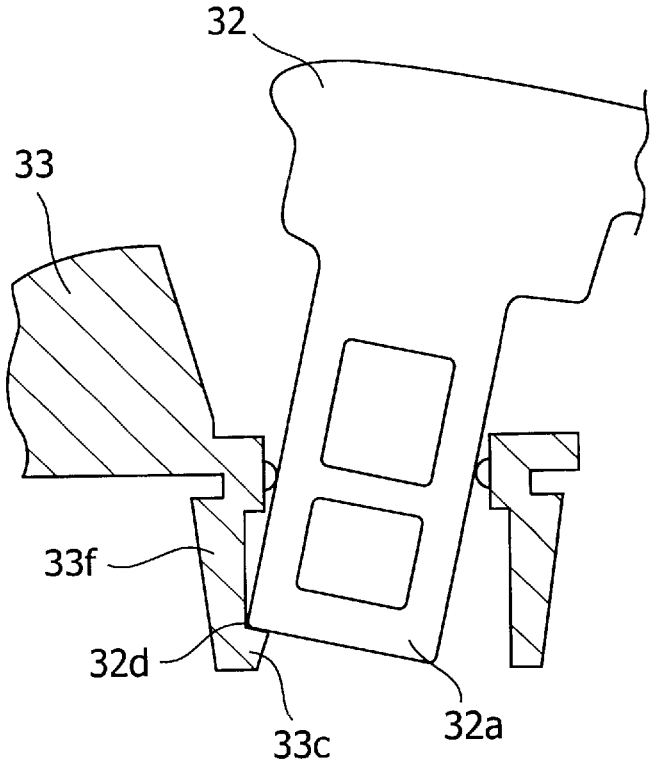
FIG. 6 is an enlarged view of portion B of FIG. 5.

As shown in FIG. 6, a stopper portion (protruding portion) 33*c* is provided on the inside at the end of the wall portion 33*f* erecting on the back face of the case portion 33. The stopper portion 33*c* is formed by a groove or a protrusion provided on the wall portion 33*f*. As shown in FIG. 5, when the grip portion 32 is pulled out and the case portion 33 is tilted through angle A as compared with the state in which the case portion 33 is installed to the door outer panel 5 (see reference character 33*b*), a corner portion 32*d* at the tip end of the arm portion 32*a* engages with the stopper portion 33*c*. As shown in FIG. 5, the corner portion 32*d* is provided on the outer peripheral surface side of the arm portion 32*a* which turns around an axis 31*a* on the base portion 31 when the grip portion 32 is pulled out, and the stopper portion 33*c* is provided in a portion facing the outer peripheral surface.

Next, the installation of the outside handle 3 to the door outer panel 5 will be explained with reference to FIGS. 3 to 10. As shown in FIG. 3, the door outer panel 5 is provided with an attachment face element 5*a* for installing the outside handle 3. In a substantially central portion of the attachment face element 5*a*, a concave portion 5*b* recessed to the cabin side (front side of the figure) is provided to secure a space for inserting a hand when the outside handle 3 is operated. Further, the attachment face element 5*a* is formed with square holes 5*c* and 5*d*.

As shown in FIG. 5, before the outside handle 3 is installed to the door outer panel 5, first, the grip portion 32 of the outside handle 3 is pulled out of the case portion 33 against the urging force of the spring 35 (see FIG. 4), and then the case portion 33 is tilted through angle A with respect to the ordinarily installed case portion 33*a* indicated by the two-dot chain line to form a temporarily held case portion 33*b* indicated by the solid line. The arm portion 32*a* engages with the stopper portion 33*c* on the wall portion 33*f*.

As shown in FIG. 6, since the grip portion 32 in this state is pulled toward the case portion 33 by the urging force of the spring 35 (see FIG. 4), the engagement force between the corner portion 32*d* of the arm portion 32*a* and the stopper portion 33*c* increases, so that the grip portion 32 is kept in an open state even if worker's hold of the grip portion 32 is lost.

Figure 9:
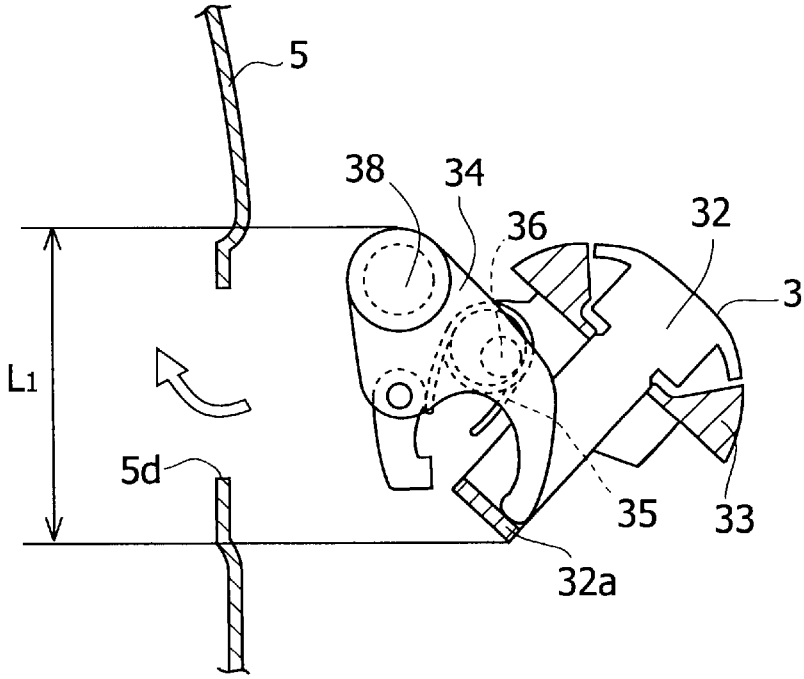
FIG. 9 is a longitudinal sectional view showing a procedure for assembling an outside handle shown in FIG. 1 to a door outer panel.
Figure 10:
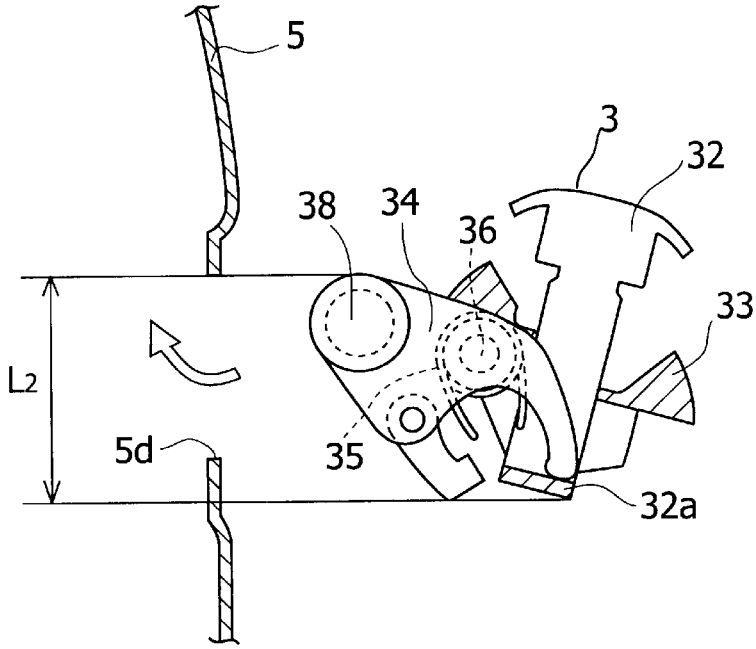
FIG. 10 is a longitudinal sectional view showing a procedure for assembling an outside handle shown in FIG. 1 to a door outer panel.

The reason why this state is established before the outside handle 3 is installed to the door outer panel 5 is as described below. As shown in FIG. 9, since the square hole 5*d* is not formed so large enough as compared with dimension L1 of the mechanism section 34, 38 plus the arm portion 32*a*, the outside handle 3 must be inserted into the square hole 5*d* so that the mechanism section 34, 38 passes through the square hole 5*d* while the outside handle 3 is tilted slightly and the angle thereof is changed. Thereupon, as shown in FIG. 10, if the grip portion 32 is made in a state of being pulled out, the bell crank 34 tilts, so that dimension L2 of the mechanism section plus the arm portion 32*a* becomes smaller than dimension L1. Therefore, merely by slightly changing the angle at the time of insertion into the square hole 5*d*, the mechanism section can be caused to pass through the square hole 5*d*, so that the door outer panel 5 does not interfere with the mechanism section, and thus the speed of assembling work can be increased.

The reason why the square hole 5*d* is not formed so large enough is as described below. The width dimension (dimension in the vertical direction of vehicle) of the grip portion 32 is determined considering the ease of grip. Considering the balance of design, the case portion 33 cannot be made much larger than the grip portion 32. If possible, the width of the case portion 33 is made equal to that of the grip portion 32, that is, the case portion 33 is made narrow in width. For this reason, the square hole 5*d* which is covered with the case portion 33 cannot be so large enough as compared with dimension L1.

As described above, when the grip portion 32 is pulled out of the case portion 33 in the state in which the outside handle 3 is not installed to the door outer panel 5, and the case portion 33 is tilted through a certain angle with respect to the grip portion 32 as compared with the state in which the outside handle 3 is installed to the door outer panel 5, the grip portion 32 engages with the case portion 33 to keep a pulled-out state. Therefore, as shown in FIG. 10, the insertion into the square hole 5*d* in the door outer panel 5 is made easy, so that the mechanism section can be inserted into the square hole 5*d*. Thus, after the base portion 31 of the outside handle 3 is inserted into the square hole 5*c*, the arm portion 32*a* and the mechanism section mainly consisting of the bell crank 34 are inserted into the square hole 5*d*.

Next, as shown in FIG. 5, in the above-described temporarily held state, the back face of the case portion 33 is still tilted through angle A, and when the tilt of the back face of the case portion 33*b* is returned and the case portion 33 is set so as to be aligned with the surface of the door outer panel 5, the corner portion 32*d* of the arm portion 32*a* comes off the stopper portion 33*c*, and thus the grip portion 32 is made in a closed state by the urging force of the spring 35.

Specifically, before the mechanism section is caused to pass through the square hole 5*d* (see FIG. 3) in the door outer panel 5, the outside handle 3 is kept in an opened state. However, at the time when the case portion 33 is installed to the door outer panel 5, and angle A between the case portion 33*a* and the grip portion 32 becomes zero so that the case portion 33*a* cannot be held temporarily, the outside handle 3 is made in a closed state.

As shown in FIG. 3, two screw holes 5*e*, 5*e* formed in the attachment face element 5*a* and internal threads 3*a*, 3*a* formed in the outside handle 3 are aligned and tightened by screws 61 and 62, by which the fixation of the outside handle 3 to the door outer panel 5 is completed. Thereafter, as shown in FIG. 4, the rod 41 of the door latch 4 is connected to the clip 37.

Figure 7:
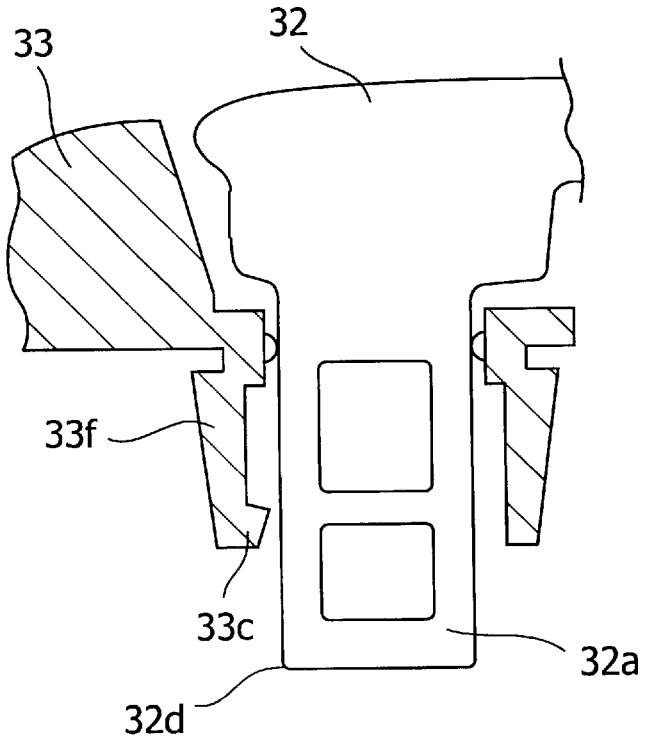
FIG. 7 is an enlarged view of portion B of FIG. 5, showing a state in which an outside handle shown in FIG. 1 is assembled to a door outer panel.
Figure 8:
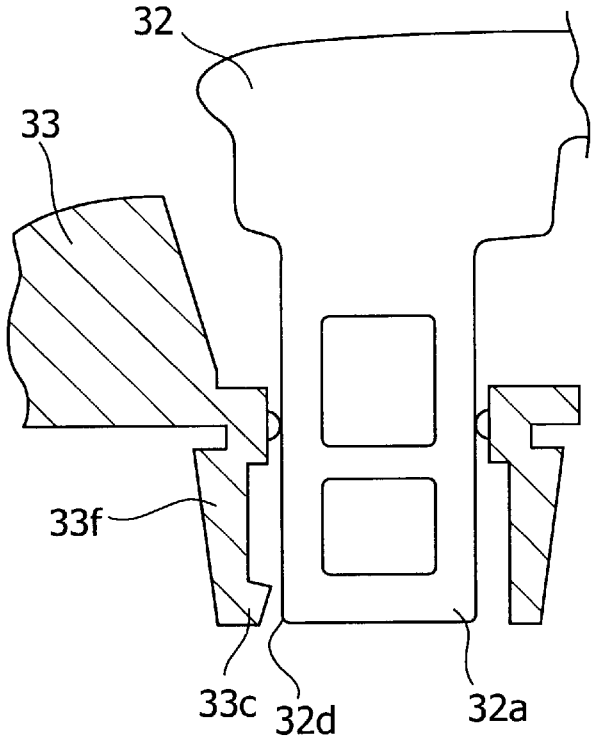
FIG. 8 is an enlarged view of portion B of FIG. 5, showing a state in which an outside handle shown in FIG. 1 is assembled to a door outer panel and a grip portion is pulled out.

Thus, by fixing the outside handle 3 to the door outer panel 5 by the screws 61 and 62, after assembling, the angle of the case portion 33 is kept in a set state, that is, zero, and the case portion 33 is not made in the state of being tilted through angle A. Therefore, as shown in FIGS. 7 and 8, at the time of the ordinary operation of the outside handle 3, the stopper portion 33*c* does not lie on a path through which the grip portion 32 is brought in and out, so that the stopper portion 33*c* and the grip portion 32 are located in positions in which they do not interfere with each other, and thus the grip portion 32 does not engage with the stopper portion 33*c* after assembling.

Figure 11:
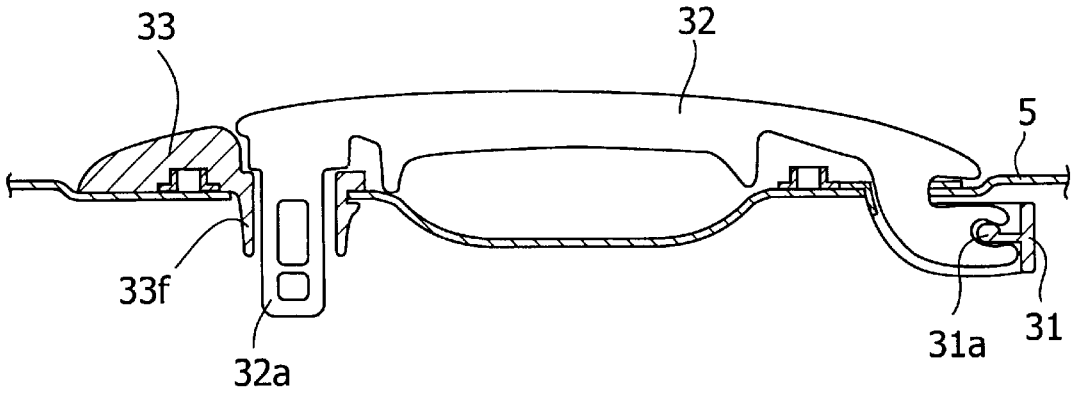
FIG. 11 is a transverse sectional view showing a state in which an outside handle shown in FIG. 1 has been assembled to a door outer panel.

The operation of the outside handle 3 after assembling will be explained with reference to FIGS. 11 to 14. FIGS. 11 and 13 show a state before the handle 3 is pulled out, and FIGS. 12 and 14 show a state of handle 3 having been pulled out.

Figure 12:
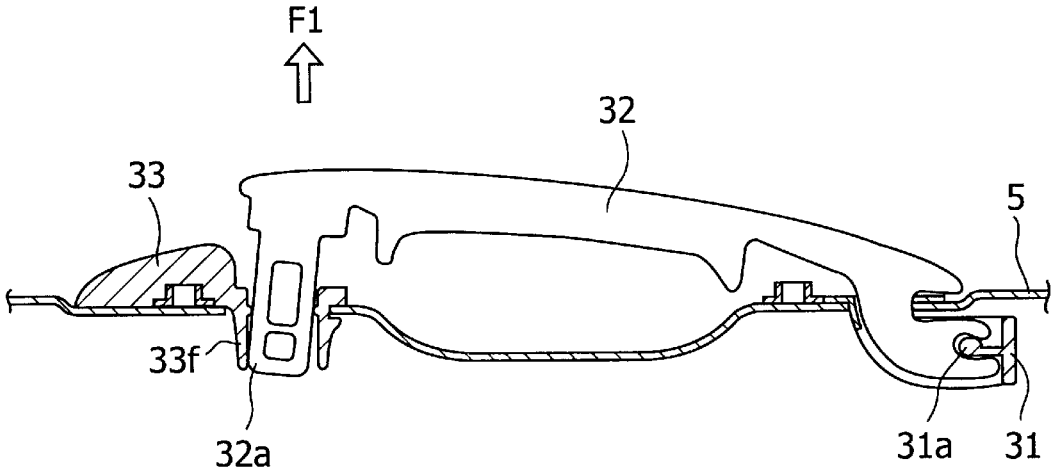
FIG. 12 is a transverse sectional view showing an operation state in which a grip portion of an outside handle is pulled out from the state shown in FIG. 11.

As shown in FIGS. 11 and 12, by pulling out the grip portion 32, the grip portion 32 is turned around the axis 31*a* on the base portion 31, and projects in the outside direction of F1 (see FIG. 12). By this operation, as shown in FIGS. 13 and 14, the arm portion 32*a* projecting from the back face of the grip portion 32 to the cabin side is moved in the case portion 33, and thereby a tip end portion 34*a* of the bell crank 34 is pushed. If the pushing force exceeds the urging force of the spring 35 in the direction of Y (see FIG. 14), the bell crank 34 turns in the direction of X (see FIG. 14) around the pin 36. By this turning of the bell crank 34, the rod 41 fixed to the bell crank 34 by the clip 37 is pushed down in the direction of Z (see FIG. 14), whereby the door latch 4 is released. F4 of FIG. 14 indicates the direction grip portion 32 moves to return to the position shown in FIGS. 11 and 13.

This embodiment, which is configured as described above, achieves the following effects:

(1) Since the construction is such that the case portion 33 makes angle A horizontally with respect to the grip portion 32, and is held by utilizing the force of the spring 35, the bell crank 34 and the counterweight 38, which constitute the mechanism section of the outside handle 3, can be inserted without a special force while the grip portion 32 is kept in a pulled-out state, so that the efficiency of assembling work increases.

(2) Since a separate stopper 8 is not used unlike the conventional construction, there is no work for installing the stopper 8 to the outside handle 3, and work for removing the stopper 8 after the outside handle 3 is installed to the door 2 is eliminated. Also, there is no need for providing a place at which the removed stopper 8 is stored at the side of the vehicle body assembling line.

(3) Since the outside handle 3 is constructed so that the grip portion 32 itself has functions, even when the outside handle 3 is removed from the door outer panel 5, the grip portion 32 can be reused, and special tools and jigs are not needed in a general servicing environment.

(4) Since the outside handle 3 has a construction such as not to interfere with other parts in a state of being installed to the door 2, and is not a large-sized structure, the influence on the strength is little, and the influence on the collision performance is kept to a minimum.

(5) Since the stopper portion 33*c* is provided on the case portion 33 unlike the conventional construction, so that the stopper portion 33*c* can be molded integrally with the case portion 33, and the construction is simple, the outside handle 3 can be manufactured at a low cost.

(6) Since an element need not be added, the function can be performed by almost the same weight as compared with the case of the original shape. Therefore, the construction of this embodiment contributes to a reduction in weight.

(7) Since the grip portion 32 can be kept in a pulled-out state merely by lightly pressing the case portion 33, there is no need for reducing the reaction force of the spring 35, and the setting of the spring 35 can have a degree of freedom.

According to this embodiment, as described above, there is provided means for temporarily holding the grip portion 32 in a pulled-out state against the urging force of the spring 35 without relying on the human power of worker when the outside handle 3 is assembled. The present invention is not limited to this embodiment, and the outside handle 3 can be used not only for a side door but also a back door. Also, it can be used for a vehicle having one side door.

Figure 15:
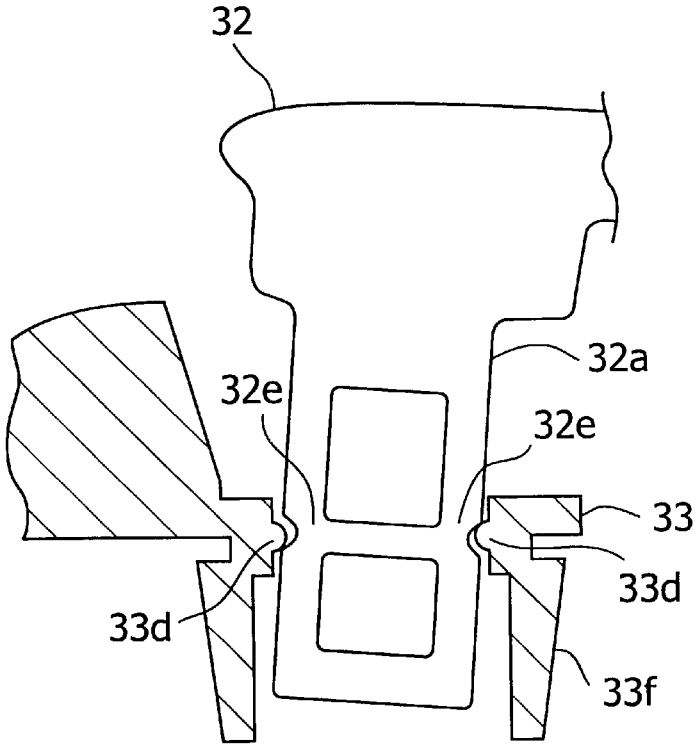
FIG. 15 is an enlarged view of portion B of FIG. 5, showing a state in which a grip portion of an outside handle in a door handle assembling construction in accordance with a first modification of the present invention is pulled out and held temporarily.

Next, various modifications will be described with reference to FIGS. 15 and 16. In a first modification shown in FIG. 15, convex portions 33*d* (protruding portions) are provided on the inside of the wall portion 33*f* of the case portion 33 so as to face each other, and concave portions 32*e* are provided in the arm portion 32*a* of the grip portion 32. In this modification, when the grip portion 32 is fully opened (pulled out to the maximum), the convex portion 33*d* engages with the concave portion 32*e*, by which a temporarily holding function is secured. Also, in the ordinary handle operating state, the convex portion 33*d* of the case portion 33 serves to support the sliding motion of the arm portion 32*a* of the grip portion 32.

Figure 16:
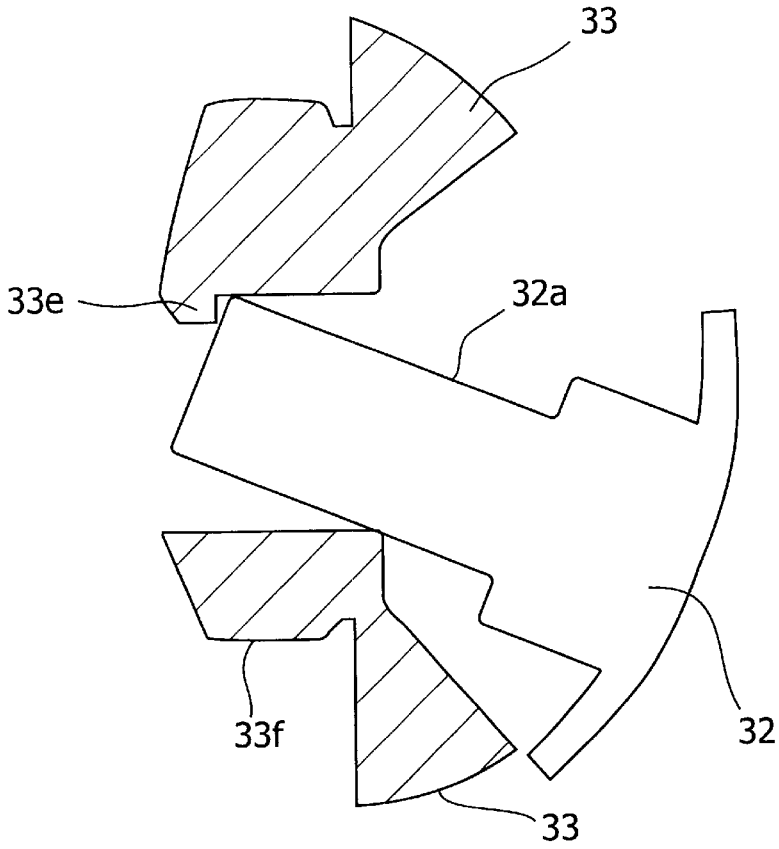
FIG. 16 is an enlarged view of portion B of FIG. 5, showing a state in which a grip portion of an outside handle in a door handle assembling construction in accordance with a second modification of the present invention is pulled out and held temporarily.
Figure 17:
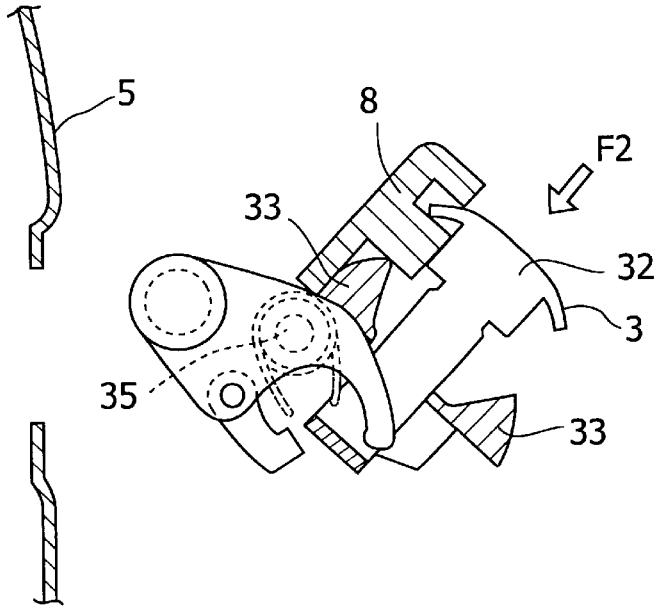
FIG.17 (RELATED ART)
FIG. 17 is a longitudinal sectional view of a conventional door handle, showing a procedure for assembling the door handle to a door outer panel.

In a second modification shown in FIG. 16, in the case where the tilt direction of the grip portion 32 with respect to the case portion 33 is vertical, the tip end of the arm portion 32*a* of the grip portion 32 engages with a step portion of a convex portion 33*e* formed on the upper inside face (face extending substantially in parallel with the lengthwise direction of the grip portion 32) of the case portion 33. Specifically, by pulling out the grip portion 32 and tilting it around the lengthwise axis thereof, the tip end of the arm portion 32*a* engages with the convex portion 33*e* of the case portion 33. In the ordinary handle operating state, the convex portion 33*e* of the case portion 33 serves to support the sliding motion of the arm portion 32*a* of the grip portion 32.

Thus, the present invention proposes a construction for temporarily holding the mechanism section, in which when the outside handle 3 that releases the door latch 4 incorporated in the door 2 via the rod 41 by means of the mechanism section interlocking with the handle pulling-out operation is installed to the door 2, in order for the mechanism section to be inserted easily into the square hole 5*d* in the door outer panel 5, the outside handle 3 is pulled out and the mechanism section can be held in a tilted state without relying on the human power of worker, and also the construction is simple and a separate part, which becomes unnecessary after the installation, is not needed.

What is claimed is:

1. A door handle assembling construction comprising:

a grip portion used for a door opening operation, a base portion for installing one end of said grip portion to a door panel, a case portion for installing the other end of said grip portion to said door panel, wherein said case portion has a wall portion erected on the back face thereof and a protruding portion provided on said wall portion, and an arm portion erected on a back face at the other end of said grip portion that moves in said wall portion, wherein said grip portion is subjected to an urging force in a first direction pulling said arm portion toward the door inside, and a mechanism section which releases a door latch interlocking with said door handle assembling construction when said grip portion is pulled out against said urging force to a pulled out position, wherein a tip end of said arm portion engages with the protruding portion on said wall portion when said grip portion is pulled out to maintain the arm portion in a pulled out position, and wherein said arm portion disengages the protruding portion on said wall portion when said grip portion is returned to said first position.

2. The door handle assembling construction according to claim 1, wherein said arm portion moving in said wall portion is formed into an arcuate shape, said grip portion turns around said base portion when being pulled out, and the protruding portion of said wall portion is provided at a position facing the outer peripheral surface of said arm portion and can be engaged with a corner portion on the outer peripheral surface side of said arm portion.

3. The door handle assembling construction according to claim 1, wherein the protruding portion of said wall portion is provided on a face extending substantially in parallel with a lengthwise direction of said grip portion, and said arm is engaged with the protruding portion of said wall portion by tilting said grip portion around a lengthwise axis thereof.

4. A door handle assembling construction comprising:

a grip portion used for a door opening operation, a base portion for installing one end of said grip portion to a door panel, a case portion for installing the other end of said grip portion to said door panel, wherein said case portion has a wall portion erected on the back face thereof and a protruding portion provided on said wall portion, and an arm portion erected on a back face at the other end of said grip portion that moves in said wall portion and is provided with a concave portion capable of being engaged with the protruding portion of said wall portion in the external surface thereof, wherein the grip portion has a first position in which the grip portion is subjected to an urging force pulling said arm portion toward the door inside, and a mechanism section which releases a door latch interlocking with said door handle assembling construction when said grip portion is pulled out against said urging force to a pulled out position, wherein said concave portion engages with the protruding portion of said wall portion when said grip portion is pulled out to maintain the grip portion in a pulled out position, and wherein said arm portion disengages the protruding portion of said wall portion when said grip portion is returned to said first position.

5. The door handle assembling construction according to claim 4, wherein the protruding portion of said wall portion is arranged in a pair so as to face each other, and the concave portion of said arm portion is formed in a pair so as to be engaged with said protruding portions.

* * * * *